US005887776A

United States Patent [19]

Munoz

[11] Patent Number: 5,887,776

[45] **Date of Patent: *Mar. 30, 1999**

[54] PORTABLE RADIO-CASSETTE ADAPTER PLATE

[76] Inventor: Jorge Munoz, 2135 Bruckner Blvd., Bronx, N.Y. 10472-6537

[ * ] Notice: This patent issued on a continued prosecution application filed under 37 CFR 1.53(d), and is subject to the twenty year patent term provisions of 35 U.S.C. 154(a)(2).

[21] Appl. No.: 729,791

[22] Filed: Oct. 8, 1996

[51] Int. Cl.[6] ..... A45F 5/00

[52] U.S. Cl. ..... 224/575; 224/269; 224/271; 224/666; 224/930

[58] Field of Search ..... 224/272, 271, 224/666, 667, 669, 670, 673, 671, 675, 663, 664, 269, 93 D, 575; 24/3.13, 302

[56] References Cited

U.S. PATENT DOCUMENTS

| | | | |
|---|---|---|---|
| 2,543,313 | 2/1951 | Dietzgen | 224/26 |
| 4,479,596 | 10/1984 | Swanson | 224/236 |
| 4,775,083 | 10/1988 | Burger et al. | 224/253 |
| 4,828,153 | 5/1989 | Guzik et al. | 224/670 |
| 4,858,798 | 8/1989 | Siddoway et al. | 224/242 |
| 4,877,167 | 10/1989 | McNemar | 224/666 |
| 5,081,709 | 1/1992 | Benyo et al. | 224/669 |
| 5,121,865 | 6/1992 | Howard | 224/253 |
| 5,443,192 | 8/1995 | Hodges et al. | 224/253 |
| 5,452,497 | 9/1995 | Peng | 224/271 |

*Primary Examiner*—Linda J. Sholl
*Attorney, Agent, or Firm*—Goldstein & Canino

[57] ABSTRACT

A portable radio-cassette adapter plate which is secured to a portable radio. An offset belt clip is secured to the portable radio-cassette adapter plate by an offset belt clip tether which is adjustable in length. By clamping the offset belt clip to a waistband or belt of a user, the portable radio is suspended comfortably by the offset belt clip tether. The distance which the portable radio is suspended below the waistband or belt of the user may be varied for comfort according to personal preference.

9 Claims, 4 Drawing Sheets

PORTABLE RADIO-CASSETTE ADAPTER PLATE

BACKGROUND OF THE INVENTION

The invention relates to a portable radio-cassette adapter plate. More particularly, the invention relates to a portable radio-cassette adapter plate which is secured to a portable radio-cassette device such as the so-called "Walkman" and permits the device to be worn comfortably about a user's midsection, or worn over the user's shoulder.

The popularity of personal, compact portable radio-cassette devices has risen steadily over the past decade. By providing a user with a compact, lightweight and convenient source of discrete music, these devices have gained popularity with persons from all walks of life. Typically comprising a small, lightweight radio/cassette module with lightweight earphones attached thereto, these devices allow individuals to enjoy their preferred musical artists without inconveniencing or annoying others.

Normally, individuals can be seen exercising, strolling, relaxing and even commuting via public transportation while utilizing these portable devices. Quite often, a user will conceal the portable radio-cassette device in a loose jacket/pants pocket or inside a knapsack or similar garment worn by the user. This often proves cumbersome and inconvenient to the user since limited pocket space is displaced by the mass of the device. In addition, the device must be removed from the pocket or knapsack within which it is contained in order for the user to access the controls of the unit, such as, for example, to replace an audio cassette or change a radio station. Alternatively, individuals can often be seen grasping the device with one hand as they engage in athletic activities such as jogging, rollerblading, etc. While this solves the problem mentioned above insofar as the device and its controls are readily accessible, it nevertheless restricts the user to the use of only one of his or her hands.

In attempts to make the use of these portable radio-cassette devices even more enjoyable, manufacturers have typically supplied them with detachable belt clips which are capable of being affixed to the rear face of the device. These belt clips typically comprise a spring tensioned armature which grasps onto the user's belt or waistband in order to suspend the compact portable radio-cassette device therefrom in an attempt to permit the user to engage in hands-free unencumbered activities. When said portable radio-cassette devices are being used in a manner such as that described above (i.e. contained within a pocket or held in the user's hand), the detachable belt clip is not employed and thus removed from the device in order to decrease the size and mass of the device.

The utilization of these detachable belt clips has failed to provide the users of portable radio-cassette devices with any extra level of comfort and convenience, however. Quite often, as a result of the user bending or sitting down, the portable radio cassette device digs into the user's mid-section causing great discomfort. Furthermore, the device may also disengage from the user's mid-section (either as a result of the belt-clip becoming too loose, or the carriage of the portable radio cassette device itself becoming stressed and breaking at the location where the belt-clip is attached thereto) thus allowing the device to suffer potential damage in the event that it drops to the ground.

Carrying devices such as cases and pouches which envelope and support the portable radio cassette device have also been found on the market. While typically secured to the user's mid-section similar to the detachable belt-clips mentioned above, these apparatus suffer similar consequences like being knocked or jarred loose from the user's person in response to the user bending or sitting. Additionally, these carrying cases and pouches also tend to conceal many of the controls of the portable radio cassette device, thus necessitating that the wearer inconveniently remove the portable radio cassette device from the pouch each time he or she needs to tend to the controls of the device.

While these units may be suitable for the particular purpose employed, or for general use, they would not be as suitable for the purposes of the present invention as disclosed hereafter.

SUMMARY OF THE INVENTION

It is an object of the invention to produce a portable radio carrying plate.

It is another object of the invention to produce a portable radio-cassette carrying plate which is secured to a portable radio-cassette device and permits the device to be worn comfortably yet securely about a user's midsection.

It is a further object of the invention to allow a user of a portable radio-cassette device to easily and conveniently secure the instant invention to a rear face of his or her portable radio-cassette device in place of a detachable belt-clip which is normally supplied therewith.

It is a still further object of the invention to produce a portable radio-cassette carrying plate which attaches to a user's portable radio-cassette device and permits said device to be worn about the user's midsection, suspended in an offset orientation from the user's waistband or belt, substantially below said waistband or belt.

It is yet a further object of the invention to produce a portable radio-cassette carrying plate which attaches to a user's portable radio-cassette device and permits said device to be worn about the user's midsection, suspended loosely and comfortably from a waist harness which engages the portable radio-cassette carrying plate in a plurality of positions and encircles the user's waistband, thus positioning the portable radio-cassette device substantially below said waistband.

The invention is a portable radio-cassette adapter plate which is secured to a portable radio by means of a fastener which may mate with a clip receptacle commonly found on the rear of most portable radios. An offset belt clip is secured to the portable radio-cassette adapter plate by an offset belt clip tether which is adjustable in length. By clamping the offset belt clip to a waistband or belt of a user, the portable radio is suspended comfortably therefrom. The distance which the portable radio is suspended below the waistband or belt of the user may be varied for comfort according to personal preference.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
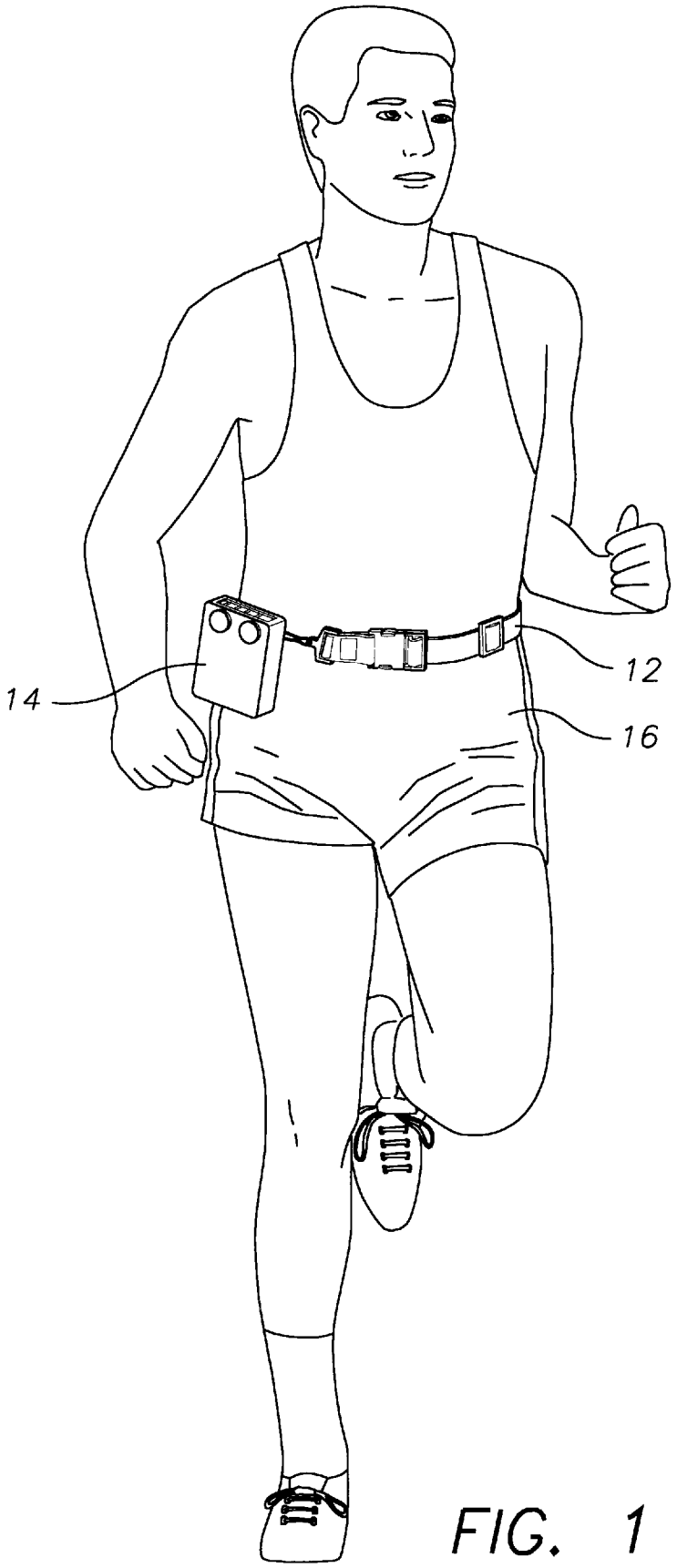
FIG. 1 is a perspective view of a portable radio-cassette adapter plate being used, in conjunction with a detachable harness strap, to suspend a portable radio comfortably from the waist of a user.
Figure 2:
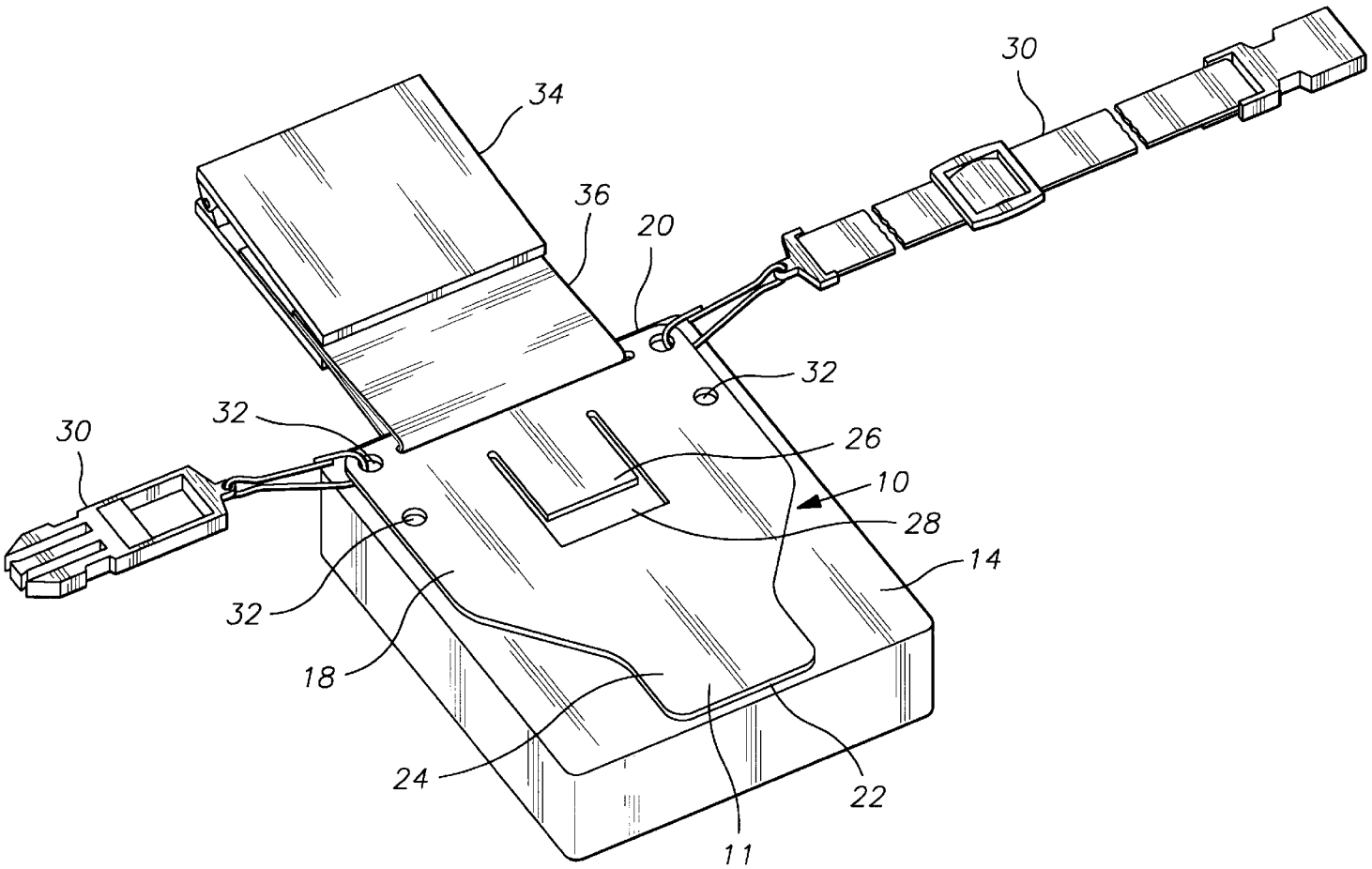
FIG. 2 is a perspective view of the portable radio-cassette adapter plate secured to a rear face of the portable radio, with the detachable harness strap and an offset belt clip fastened thereto.

FIG. 1 illustrates a portable radio-cassette adapter plate 10 (not visible) being used in conjunction with a detachable strap 12 to suspend a portable radio 14 comfortably from the waist of a user 16. As seen in FIG. 2, the portable radio-cassette adapter plate 10 comprises a panel 11 having a top end 20 and a bottom end 22, said bottom end 22 tapering inward such that it is narrower than the top end 20, thus forming a tab portion 24. A fastener 26 (schemetically shown) located at the center region of the panel 11 of the portable radio-cassette adapter plate 10 mates with a standard clip receptacle 28 (schemetically shown) commonly found on the rear of most portable radios 14, permitting said adapter plate 10 to be firmly secured to the rear of the portable radio 14.

Figure 3:
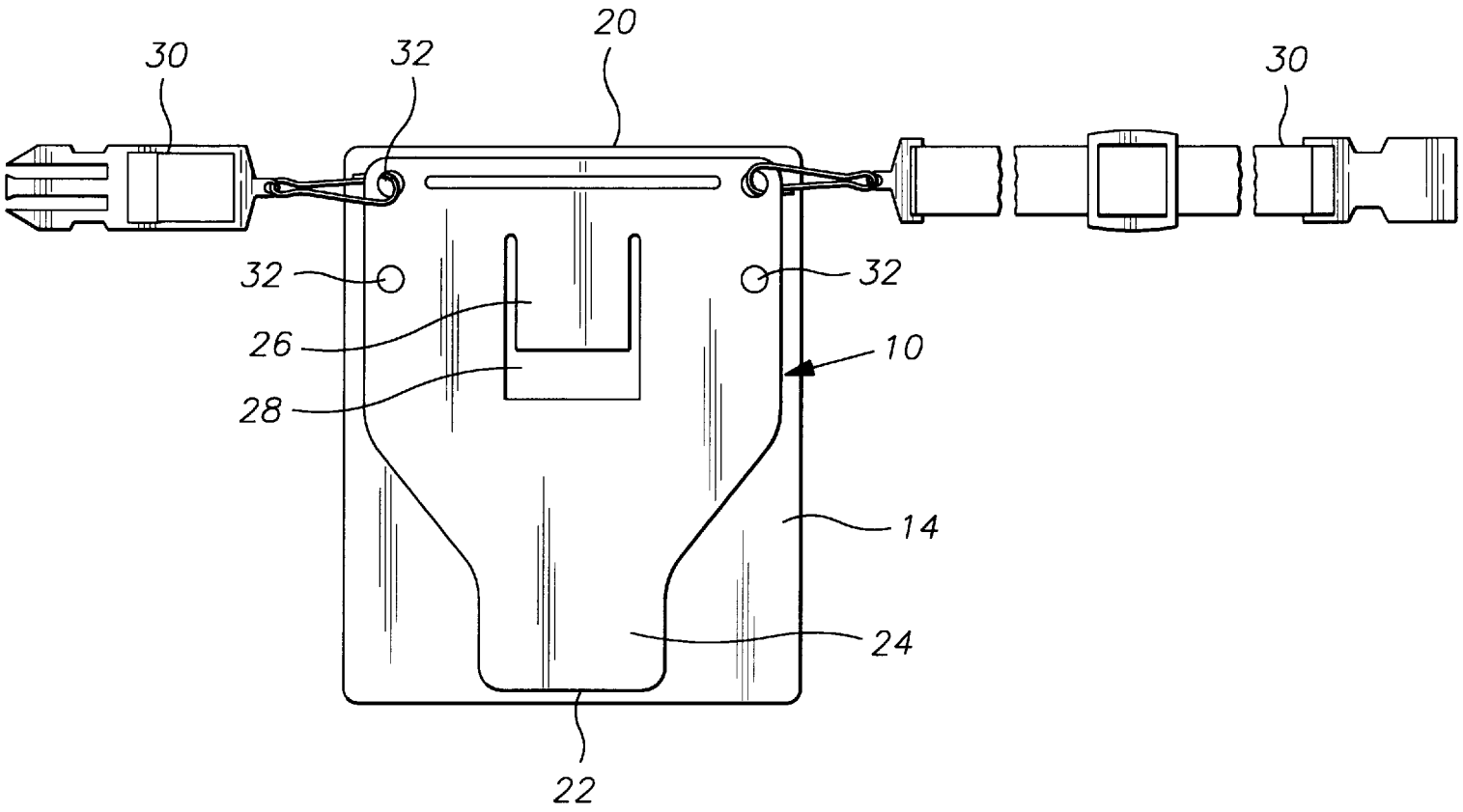
FIG. 3 is a rear plan view of the portable radio-cassette adapter plate secured to the rear face of the portable radio.

Also shown in FIG. 2, as well as FIG. 3, is a detachable harness strap 30 which may be detachably secured to the portable radio-cassette adapter plate 10 in a variety of positions. As seen, the detachable harness strap 30 is secured to the portable radio-cassette adapter plate 10 via a plurality of harness strap receptacles 32. The position of the detachable harness strap 30 may be varied by alternating the harness strap receptacles 32 to which said detachable harness strap 30 engages. The detachable harness strap 30 may be worn loosely and comfortably about the user's 16 waist as seen in FIG. 1, worn around the user's 16 neck, or slung over the user's 16 shoulder (not shown).

Figure 4:
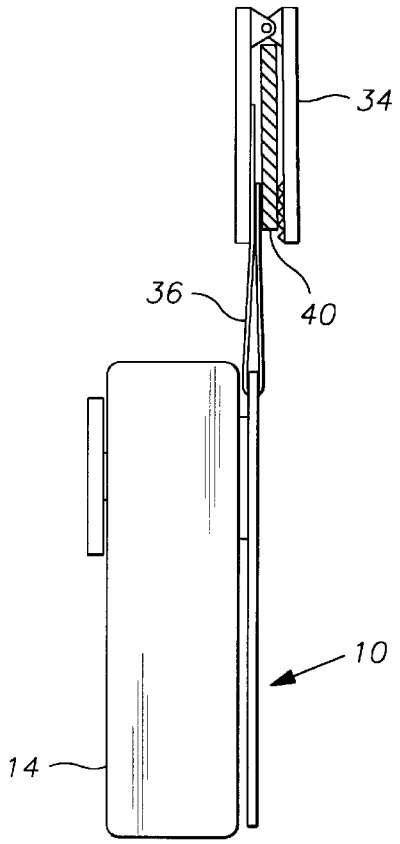
FIG. 4 is a side view of the portable radio-cassette adapter plate secured to the rear face of the portable radio, with the offset belt clip secured thereto.
Figure 5:
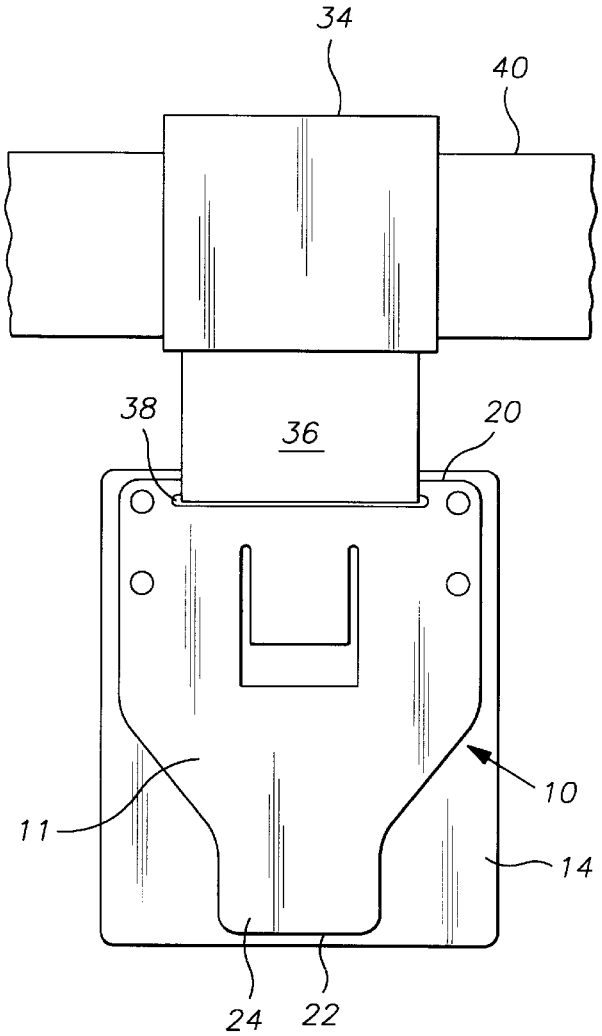
FIG. 5 depicts the offset belt clip fastened to a belt, thus suspending the portable radio, via the portable radio-cassette adapter plate, therefrom.

Additionally shown in FIG. 2 is an offset belt clip 34 and an offset belt clip tether 36, both of which would be used as an alternate to using the detachable harness strap 30. The employment of the offset belt clip 34 and offset belt clip tether 36 is best illustrated by reference to FIGS. 4 and 5. There it can be seen that the offset belt clip tether 36 is looped through a slot 38 located upon the portable radio-cassette adapter plate 10 at the top end 20 thereof. Accordingly, the lower portion of the offset belt clip tether 36 is secured to the portable radio-cassette adapter plate 10, while the top is secured to the offset belt clip 34 itself. The length of the offset belt clip tether 36 is fixedly adjustable via hook and loop fasteners or other suitable means. By clamping the offset belt clip 34 upon a user's waistband or belt 40, the portable radio 14 is suspended thereunder a predetermined yet comfortable distance away, such that the user 16 is free to bend and kneel without the discomfort of a closely mounted portable radio 14 digging in to the user's 16 mid-section.

Finally, the tab portion 24 located at the bottom end 22 of the portable radio-cassette adapter plate 10 functions as a traditional belt clip, allowing the user 16 to insert said tab portion 24 inside his belt or waistband 40, with said belt or waistband 40 being secured between the tab portion 24 of the portable radio-cassette adapter plate 10 and the rear of the portable radio 14. The portable radio 14 is hence rigidly secured thereat, preventing any movement such as that which might occur when the offset belt clip 34/offset belt clip tether 36 assembly is employed and the portable radio is loosely suspended from the offset belt clip tether 36.

What is claimed is:

1. A portable radio-cassette adapter plate for carrying a portable radio, enabling the portable radio to be suspended comfortably from the body of a user, the portable radio-cassette adapter plate comprising;

a) a panel having a top end and a bottom end, the top end having a slot provided thereat, the panel adapted to be firmly secured to the portable radio;

b) an offset belt clip configured for removable attachment to one of a waistband and a belt worn by the user; and c) an offset belt clip tether having opposite ends, one end of the offset belt clip tether secured to the portable radio-cassette adapter plate, with the other end secured to the offset belt clip;

d) the bottom end of the panel tapering inward such that it is narrower than the top end, thus forming a tab portion that enables the portable radio-cassette adapter plate to function as a traditional belt clip, thereby enabling the user to insert the tab portion inside one of the waistband and the belt to secure the portable radio-cassette adapter plate to the user.

2. The portable radio-cassette adapter plate of claim 1, wherein the end of the offset belt clip tether secured to the portable radio-cassette adapter plate is secured thereto by looping the tether through the slot at the top end.

3. The portable radio-cassette adapter plate of claim 1, further including:

a) a plurality of harness strap receptacles provided in the panel at the top end; and b) a detachable harness strap that is secured to the panel via at least one of the harness strap receptacles.

4. The portable radio-cassette adapter plate of claim 1, wherein the length of the offset belt clip tether is adjustable so that the distance the portable radio-cassette is suspended below the waist of the user may be varied according to personal preference.

5. A portable radio-cassette adapter plate for carrying a portable radio type device, enabling the portable radio type device to be suspended comfortably from the body of a user, the portable radio-cassette adapter plate comprising:

a) a panel having a top end and a bottom end, the bottom end of the panel tapering inward such that it is narrower that the top end, thus forming a tab portion that enables the portable radio-cassette adapter plate to function as a traditional belt clip, thereby enabling the user to insert the tab portion inside one of a waistband and a belt worn by the user to secure the portable radio-cassette adapter plate to the user;

b) an offset belt clip configured for removable attachment to one of the waistband and the belt;

c) an offset belt clip tether having opposite ends, one end of the offset belt clip tether secured to the portable radio-cassette adapter plate, with the other end secured to the offset belt clip;

d) a plurality of harness strap receptacles positioned near the top end of the panel; and e) a detachable harness strap which is secured to the panel by at least one harness strap receptacle;

f) the offset arrangement of the offset belt clip and the panel resulting in the comfortable suspension of the portable radio type device from the body of a user.

6. The portable radio-cassette adapter plate of claim 5, wherein the length of the offset belt clip tether is adjustable so that the distance the portable radio-cassette is suspended below the waist of the user may be varied according to personal preference.

7. The portable radio-cassette adapter plate of claim 6, further including a slot at the top end, wherein the end of the offset belt clip tether secured to the portable radio-cassette adapter plate is secured thereto by looping through the slot.

8. A portable radio-cassette adapter plate for carrying a portable radio cassette type device, enabling the portable radio type device to be conveniently carried on the body of a user, the portable radio-cassette adapter plate comprising:

a) a panel having a top end and a bottom end;

b) a detachable harness strap which is attachable to the panel at selected locations proximal to the top end; the harness strap enabling the portable radio-cassette type device to be comfortably carried on the body of a user;

c) an offset belt clip configured for secure, yet removable attachment to one of a waistband and a belt worn by the user; and d) an offset belt clip tether having opposite ends, one end of the offset belt clip tether secured to the portable radio-cassette adapter plate through a slot provided at the top end thereof, with the other end secured to the offset belt clip.

9. The portable radio-cassette adapter plate of claim 8, wherein the bottom end of the panel tapers inward such that it is narrower that the top end, thus forming a tab portion that enables the portable radio-cassette adapter plate to function as a traditional belt clip, thereby enabling the user to insert the tab portion inside one of the waistband and the belt to secure the portable radio-cassette adapter plate to the user.

* * * * *